United States Patent [19]

Campana

[11] 4,119,496

[45] Oct. 10, 1978

[54] FABRICATED COKE OVEN DOOR

[76] Inventor: Patsie Carmen Campana, 2614 Sherwood Dr., Lorain, Ohio 44053

[21] Appl. No.: 795,770

[22] Filed: May 11, 1977

[51] Int. Cl.[2] ..... C10B 25/02

[52] U.S. Cl. ..... 202/248; 110/173 R

[58] Field of Search ..... 202/248; 110/173 R

[56] References Cited

U.S. PATENT DOCUMENTS

| | | | |
|---|---|---|---|
| 2,606,865 | 8/1952 | Forsans | 202/248 |
| 3,933,598 | 1/1976 | Pries | 202/248 |
| 3,996,110 | 12/1976 | Campana | 202/248 |
| 4,028,193 | 6/1977 | Nagayoshi | 202/248 |

*Primary Examiner*—Morris O. Wolk
*Assistant Examiner*—Roger F. Phillips
*Attorney, Agent, or Firm*—Fay & Sharpe

[57] ABSTRACT

A coke oven door fabricated from steel plate including a rectangular main door plate having inner and outer planar door faces. A pair of side support plates are rigidly affixed to the main door plate outer surface to extend longitudinally therealong adjacent the side edges thereof and a pair of end support plates are similarly mounted adjacent the main door plate end edges so as to form a door support frame. A plurality of gusset members are symmetrically disposed generally about the midpoint of the main door plate outer face and extend from one of the side support plates toward the other across the main door plate outer face. A sealing ring is affixed to the main door plate inner surface and adapted to sealingly engage a door frame when the door is placed over the coke oven opening. A plurality of fabricated adjusting means are disposed on the outer door face adjacent the side and end support plates with each such means having an adjustment plunger passing through the door plate into communication with the sealing ring. During oven operation and as the temperature inside the oven becomes elevated, the door frame is subjected to heat induced warpage. The sealing ring may then be adjusted through use of the individual adjusting means to close any resulting gaps between the sealing ring and door frame. Thereafter, the door itself will flex under the influence and urging of the conventional door mounting or latching means to compensate for and seal against further door frame warpage. Because of the particular gussetted arrangement utilized, there is very little flexure of the door at the midpoint thereof with primary flexure occurring away from the center toward the outer edges.

18 Claims, 4 Drawing Figures

FABRICATED COKE OVEN DOOR

BACKGROUND OF THE INVENTION

This invention relates to a door construction and more particularly to a fabricated door construction which is exposed to high temperatures.

The invention is particularly applicable to use as a coke oven door or door assembly and will be described with particular reference thereto; however, it will be appreciated by those skilled in the art that the invention has broader applications and may be used in other environments where a door assembly which is exposed to high temperatures must resist or adapt to heat induced warpage which would otherwise prevent it from performing its intended function in the intended manner.

Coke oven is a term employed for large ovens which are used to produce coke and coke by-products from coal. While there are a number of types and styles of coke ovens, they typically have a substantial vertical height and depth in relation to the width and, in some respects, resemble a very large closet. In many instances, the height of these ovens is well over 10 feet and a substantial portion of the front faces thereof may be selectively opened and closed by means of a coke oven door. Normally, a plurality of the individual ovens are located in a side by side relationship to form what is commonly termed an oven battery in order that a high volume of coke and coke by-products may be simultaneously made at one location.

In the type of coke oven described above, an oven door frame is provided which, in actuality, normally covers or defines substantially the entire front wall of the oven itself. This frame has an opening which is elongated in the vertical direction and defines the coke oven access opening. Interposed between the outer peripheral surface of this elongated opening and the outer peripheral edges of the frame itself in a manner to extend outwardly from the outer face thereof is a support structure. This structure provides some rigid support for the frame in an effort to eliminate or at least reduce somewhat frame warpage encountered during a coking operation. Warpage is a significant problem due to the high temperatures, e.g., 2000° F. and above acting on the inside face of the frame and door during such operations. Finally, a large elongated coke oven door is employed to selectively cover the coke oven access opening. The inside face of the oven door typically includes a sealing ring or diaphragm which seals the door against the door frame and which may be independently adjusted between defined limits relative to the door in order to maintain the desired sealing relationship at the occurrence of at least some heat induced warpage.

In prior coke ovens, the frames and oors have been constructed of cast iron and have typically been case by foundries to be very thick or heavy in order to withstand the elevated operating temperatures and to provide rigidity therefor. However, such cast iron frames have an extremely undesirable characteristic in that they will loose their original shape when subjected to elevated temperatures and "hour-glass" or otherwise warp. As they become distorted, it is extremely difficult to maintain a good sealing relationship between the coke oven door or sealing ring and the door frame. In that event, leaks develop around the oven door such that there are heat and pollution losses from the oven as well as air admission into the oven. Such circumstances are undesirable from both environmental and overall operational points of view.

While typical prior sealing ring arrangements have facilitated some independent adjustments thereof to reduce such leakage, they have proved ineffective when extreme frame "hour-glassing" or warping is present. Because prior coke oven doors were made of heavy cast iron for obtaining the most rigid door construction possible, the doors themselves would not conform to the warped configuration of the frame to aid in eliminating or at least reducing door leakage problems. Thus, once maximum adjustment for the prior sealing rings or diaphragms was obtained, there were no practical further steps which could be taken to insure proper door sealing.

The subject invention is directed toward a new and improved construction for a coke oven door which overcomes the above discussed problems and provides a new and improved door which is simple to manufacture, readily adaptable to use on the various types and styles of conventional coke ovens, provides a door structure which is strong and provides a door structure which is flexible in the event there is distortion incurred in the frame during coking operations.

BRIEF DESCRIPTION OF THE PRESENT INVENTION

In accordance with the present invention, there is provided an improved door for a coke oven of the type having an elongated vertical opening in the front wall thereof with a door frame disposed about at least a portion of the opening. A door is adapted to be placed in a covering relationship over the opening. The door further includes means for releasably maintaining it in position and for urging it toward sealing communication with the door frame. The improved coke oven door is fabricated from steel plate to include a main door plate having inner and outer planar faces, a pair of opposed side edges and a pair of opposed end edges, with the inner planar face adapted to be closely spaced toward the door frame. A steel side support plate is rigidly affixed to the main door plate outer face adjacent each of the side edges thereof and a steel end support plate is similarly rigidly affixed adjacent each of the end edges thereof such that the side and end plates extend generally normally outward from the outer face and form a frame-like arrangement. A plurality of separate gusset members are rigidly positioned generally symmetrically about the midpoint of the outer face with each gusset member disposed to extend laterally across a portion of the outer face from one of the side plates. The above arrangement for the new coke oven door allows the door to be flexed during oven operation at elevated temperatures so that the main door plate inner face will conform to the contour of the frame in response to the urging of the maintaining means as the frame is warped due to exposure thereof to elevated oven operating temperatures. An effective seal between the oven door and frame may thereby be successfully maintained.

In accordance with another aspect of the present invention, the plurality of gusset members comprise two gusset members associated with each of the pair of side plates. The gusset members associated with each of the side plates are generally equidistantly spaced from and on opposite sides of the midpoint of the main door plate outer face. The gusset members associated with each of the two side plates are in longitudinal alignment with the gusset members of the opposite side plate.

In accordance with still a further aspect of the present invention, a separate sealing means is associated with the inner face of the coke oven door for cooperative sealing engagement with the door frame. The sealing means is mounted for selective forced movement outwardly from the inner face between defined limits to maintain proper sealing between the door and frame during operation of the oven at elevated temperatures. The improved fabricated coke oven door includes a plurality of fabricated adjusting means disposed in a spaced apart relationship from each other generally peripherally around the main door plate outer face adjacent the side and end plates. Each of the separate adjusting means extends through the main door plate from the outer to the inner face thereof into communication with the sealing means.

In accordance with yet a further aspect of the present invention, each of the fabricated adjusting means is comprised of an adjusting means housing rigidly affixed to the main door plate with the housing having an opening therethrough in coaxial alignment with a receiving opening in the main door plate communicating between the outer and inner faces thereof. An adjustment plunger is received in the housing opening with a portion thereof dimensioned to be received through the receiving opening into direct communication with the sealing means. Means are also included for selectively moving the adjustment plunger through the housing opening for forcibly moving a portion of the sealing means between a first normal position closely spaced to the door plate inner face and a second position spaced outward of the inner face from the first position whereby selected portions of the sealing means may be selectively adjusted to compensate for some initial warpage in the door frame as the operating temperature in said oven becomes elevated.

The principal object of the present invention is the provision of a new and improved coke oven door which is flexible and which allows improved sealing characteristics with an associated coke oven door frame during coke oven operation at elevated temperatures.

Another object of the present invention is the provision of a new and improved coke oven door which is easy to manufacture.

Still another object of the present invention is the provision of a new and improved coke oven door which may be constructed from readily available and conventional materials.

Other objects of the invention will become apparent to those skilled in the art from a reading and understanding of the following specification and claims.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
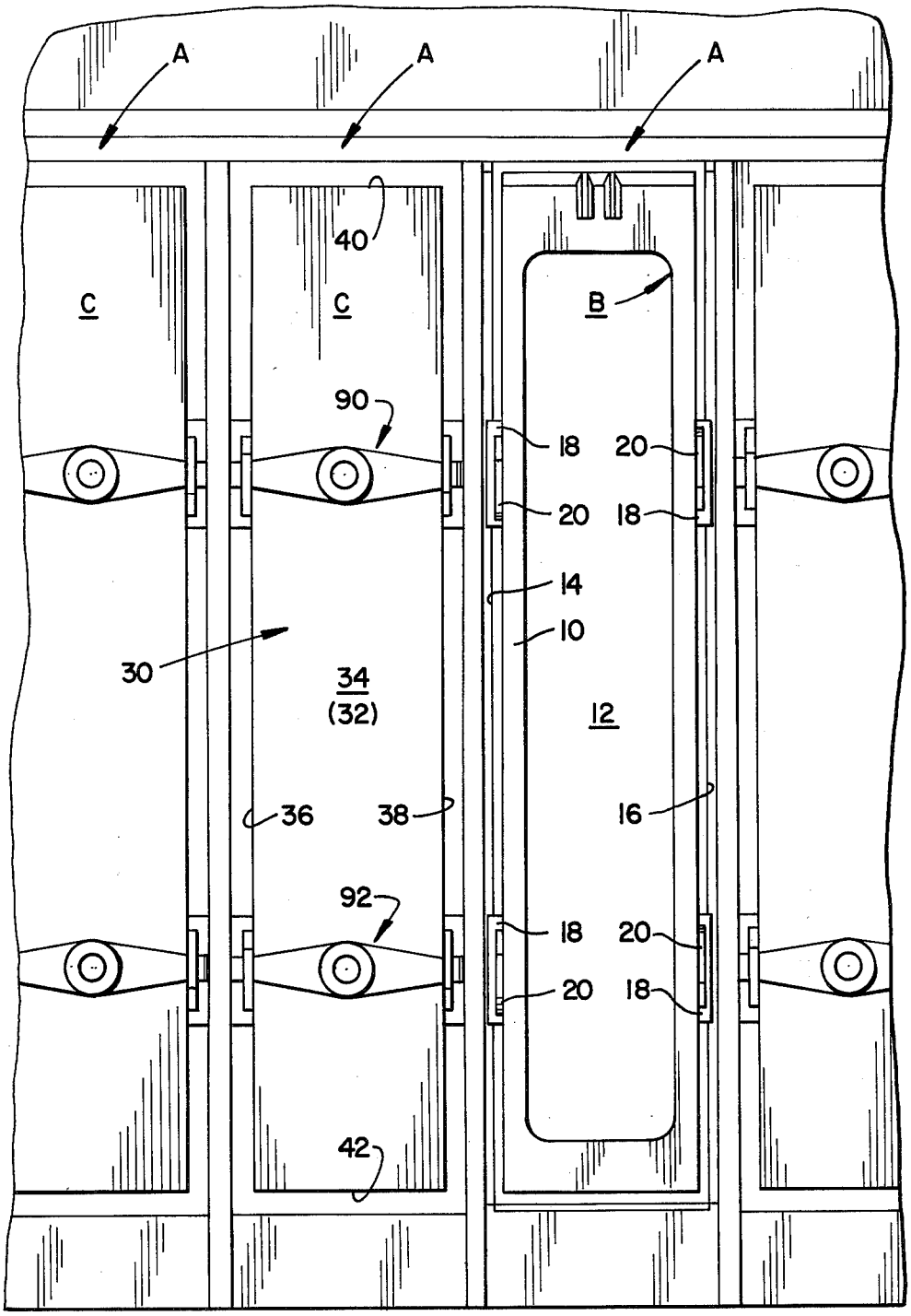
FIG. 1 is a front elevational view of a coke oven battery showing typical coke oven door installations with one of the doors removed for showing a typical coke oven door frame.

Referring now to the drawings wherein the showings are for purposes of illustrating the preferred embodiment of the invention only and not for purposes of limiting same, the FIGURES show a coke oven battery comprised of a number of individual coke ovens A which each include a coke oven door frame B and a coke oven door C.

More particularly and with reference to FIG. 1 in which certain showings are schematic in nature to merely allow an appreciation of the environment involved, door frame B includes a planar outer surface 10 having an elongated rectangular opening 12 therein. Disposed along each side edge 14, 16 of frame B to extend outwardly from planar outer surface 10 along with other reinforcing members are a pair of mounting brackets generally designated 18 to which latch bar hooks generally designated 20 are rigidly affixed. These latch bar hooks are employed for retainingly mounting a coke oven door to the associated coke oven as is known in the art and as will be further appreciated hereinafter.

There are many specific configurations and styles of frames B which are in actual use. Heretofore, prior coke oven door frames have been primarily constructed from cast iron and been very bulky and heavy in order to add a degree of rigidity to the structure during oven operation when oven temperatures may be in excess of 2000° F. As a result of this construction and during oven operation, prior door frames have warped or hourglassed such that planar outer surface 10 becomes wavey or distorted. When such waveyness or distortion occurs, it has heretofore been extremely difficult, and in many instances impossible, to maintain a good sealing relationship between the coke oven door C and the associated coke oven door frame B.

The above problems with frame distortion are deemed to be successfully overcome in using the concepts of the subject invention. More particularly, attention is invited to FIGS. 2–4 in which a more specific showing of the new coke oven door structure is made. Door C is comprised of a main door plate 30 constructed of stress relieved steel having an inner planar face 32, an outer planar face 34, opposed side edges 36, 38 and opposed end edges 40, 42. The length and width of main door plate 30 will vary between oven installations in order to accommodate various styles and sizes thereof; however, in the preferred arrangement of the invention here under discussion, plate 30 has a thickness of approximately $1\frac{1}{4}$ inches.

A pair of side support plates 50,52 are disposed to extend longitudinally along outer planar face 34 of plate 30 adjacent side edges 36, 38, respectively. A pair of end support plates 54, 56 are similarly disposed adjacent end edges 40, 42, respectively, so as to extend between side support plates 50, 52. It should be particularly noted that plates 50, 52, 54 and 56 extend generally normally outward from outer planar face 34 and define a ledge or flange area between the outside surfaces thereof and edges 36, 38, 40 and 42. The side and end support plates are rigidly affixed to the main door plate and to each and one such assembly, it being understood that all other are identical thereto unless specifically noted.

Figure 4:
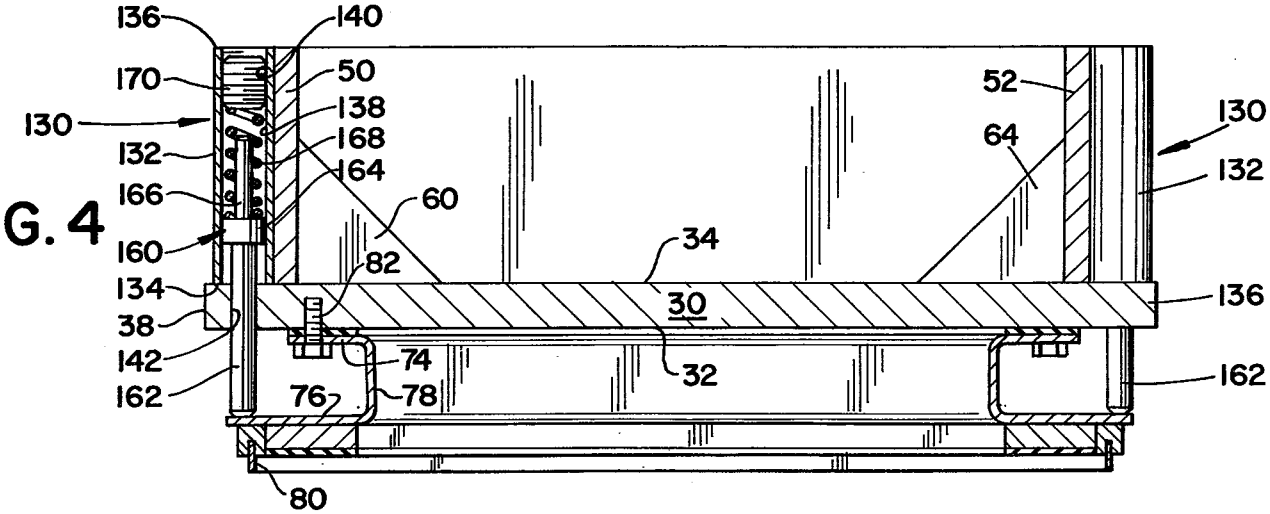

Each adjustment assembly 130 is comprised of an assembly housing 132 having an inner or lower end 134 and an outer or upper end 136 with a bore 138 communicating between these two ends. Bore 138 includes a threaded area 140 extending longitudinally therealong over a portion thereof from upper end 136. The housings of the individual adjustment assemblies 130 are positioned to extend generally normally outward from outer planar face 34 of the main door plate and are rigidly affixed to the outwardly facing surface of the associated side or end support plate by any convenient means such as welding. Moreover, and as best shown in FIG. 4, each housing is disposed so that bore 138 thereof is in coaxial alignment with an associated receiving opening or bore 142 in the main door plate itself. As will be noted, receiving opening or bore 142 is slightly smaller in cross section than bore 138 of the associated housing 132. For ease of fabrication and construction of the overall coke oven door, housings 132 may be conveniently constructed from conventional pipe or the like and then tapped as desired to provide the longitudinal threaded area 140.

An adjustment plunger generally designated 160 is slidably received within bore 138 and includes an elongated lower end 162, an intermediate outwardly extending flange 164 and an elongated upper end 166. Lower end 162 is dimensioned to be slidably received through opening 142 and flange 164 is slightly larger than this opening as to act as and provide a positive stop for advancement of the planger through the main door plate. A compression spring 168 is dimensioned to be received over upper plunger end 166 with one end bearing against flange 164 and the other end extending upwardly beyond the outer end of the upper plunger end. Finally, a threaded adjusting plug 170 is threadedly received in threaded area 140 with the bottom surface thereof being engaged by the upper end of compression spring 168. The top surface of the plug includes convenient means therein such as a screwdriver or other wrench receiving slot or area to facilitate ease of adjustment for sealing ring 70 externally of the oven during coking operations by means of individual adjustment assemblies 130.

FIG. 4 shows a first or normal relationship between the coke oven door and sealing ring prior to the time the door is installed over the coke oven frame for commencement of a coking operation. Here, the threaded adjusting plug 170 of all the adjustment assemblies 130 are retracted so that the natural resiliency in the basic sealing ring U or S-shaped cross section will cause the individual adjustment plungers 160 to be forced outwardly through opening 142 and base 138 against the force of compression spring 168 by outer leg 76. In other words, outer leg 76 acts as a lever arm to continuously urge the adjustment plungers toward a home position.

When the coke oven is ready for a coking operation, the coke oven door C may be conveniently lifted into place in a covering relationship with rectangular opening 12 of the associated coke oven door frame B. When so positioned, latching bars 110 of the two latching assemblies 90, 92 may be rotated into position so that they engage the associated latch bar hooks 20 extending outwardly from door frame planar outer surface 10. Such installation is conventional and known in the art and once so installed, an appropriate wrench or other tool may be utilized to threadedly advance latch bar screw lower ends 102 further into latch bushings 98 through latch bar screw upper ends 106. Once so tightened, knife-like sealing edge 80 or some other acceptable alternative means dictated by the specifics of the sealing ring itself will sealingly engage planar outer surface 10 of the coke oven door frame. In the event that this planar surface is distorted somewhat over the surface thereof creating gaps between the knife-like sealing edge and surface 10, it is possible to adjust selected portions of the sealing ring to drive the knife-like sealing edge into engagement with surface 10. This is accomplished by simply advancing the threaded adjusting plugs 170 for the appropriate adjustment assemblies 130 to compress compression springs 168 and increase the spring force applied against adjustment plungers 160 to a point where the plungers overcome the force of leg 76. Thus, the plungers will be driven forwardly through bores 138, 142 and thereby force at least selected portions of the sealing ring away from the first or normal position toward a second position spaced therefrom such that knife-like sealing edge 80 will be driven into engagement with outer surface 10 of the associated door frame B.

During a coking operation, operating temperatures inside the oven are extremely high, surpassing 2000° F., such that the door frame and door are subjected to a tremendous amount of heat. The net result of such heat exchange is that the door frame will begin to warp or hour-glass and such warpage causes the sealing ring and coke oven door frame to part from engaging contact with each other. As a result, there is heat and pollution loss from the oven as well as air admission into the oven. Such circumstances are undesirable from both environmental and overall operational points of view and are to be avoided if at all possible.

A small amount of leakage which occurs due to warping may, of course, be eliminated by making further adjustments to the sealing ring through adjusting assemblies 130 as described above. However, the amount of such adjustment is necessarily limited due to the particulars of the connecting relationship between sealing ring 70 and main door plate 30 through mechanical fasteners 82 and the particulars of the U or J-shaped cross section of sealing ring itself. The adjustment plungers may only be advanced until flange 164 thereof engages outer face 34 of the door plate. A limitation on the amount of adjustment allowed is deemed necessary to protect the integrity of the basic sealing ring construction and method of mounting thereof to the main door plate.

As the coking operation continues and the temperature inside the oven becomes further elevated, there is further and more extensive door frame warping or hour-glassing so that the permissible adjustment for the sealing ring between defined limits will be insufficient to allow resealing of the oven door against the oven door frame. The prior art cast iron doors were purposely made extremely heavy and thick so they would remain as rigid as possible. Thus, the door leakage problem had to be accepted as an ordinary and necessary operational evil to coking operations.

However, and in using the fabricated coke oven door assembly of the present invention, the door structure is such that it may flex during coking operations when it is exposed to the elevated oven temperatures. In other words, the basic difference between prior art cast iron coke oven doors and the subject fabricated coke oven other by conventional welding techniques so as to define a door support frame arrangement.

The side and end support plates are also constructed from conventional steel and the specific sizes thereof may vary between individual oven door installations. However, in the preferred arrangement here under discussion, these plates have a thickness of approximately ¾ inch.

Figure 2:
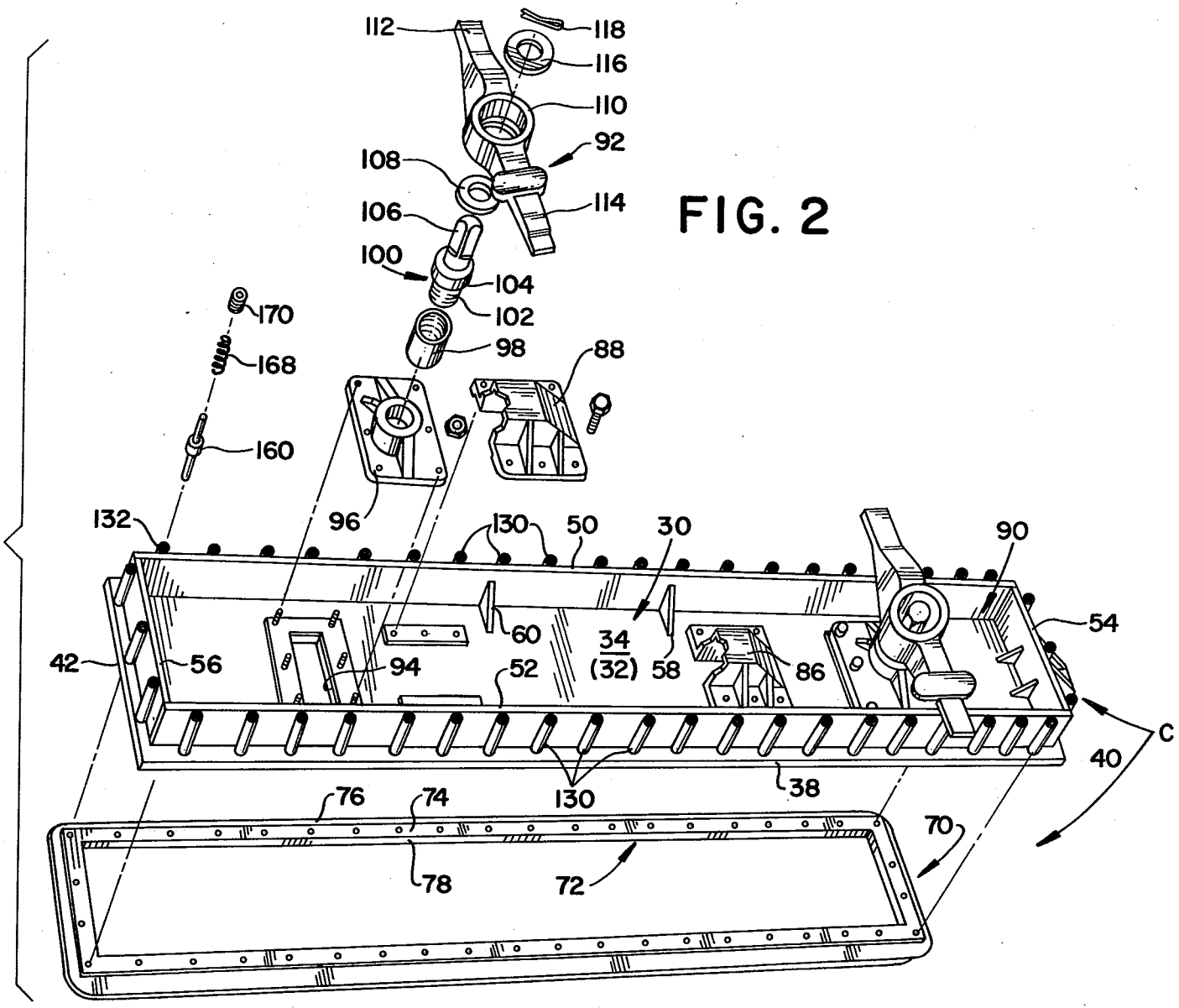
FIG. 2 is an exploded view of a coke oven door which incorporates the concepts of the subject invention thereinto.
Figure 3:
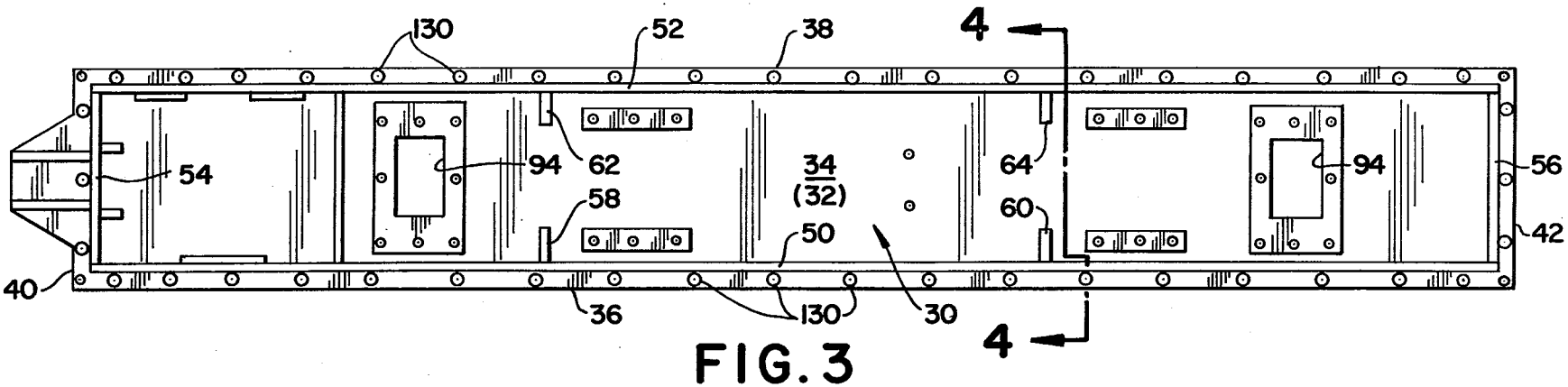
FIG. 3 is a front view of a coke oven door which incorporates the concepts of the subject invention thereinto; and, FIG. 4 is a cross-sectional view taken along lines 4—4 of FIG. 3.

Associated with side support plate 50 are a pair of gusset members 58, 60 and associated with side support plate 52 are a second pair of gusset members 62, 64. As best shown in FIGS. 2, 3 and 4, these gusset members have a generally triangular configuration with the adjacent sides thereof configured to be closely received against the inside face or surface of the associated side plate and outer planar face 34. The gussets are preferably rigidly welded to the side plates and outer planar face by conventional welding techniques. It should be particularly noted that the preferred four gusset members are generally symmetrically disposed about the midpoint area of outer planar face 34 such that gusset members 58, 60 are laterally opposed across face 34 from gusset members 62, 64 and in longitudinal alignment therewith. These gusset members provide the necessary rigidity to the overall door construction, particularly at the central area thereof for reasons and purposes which will be described hereinafter.

Many coke oven doors of the general type to which the subject invention is directed employ separate sealing means structurally associated with the inner face of the door to sealingly engage the planar outer surface of the door frame when the door is in position to close the coke oven opening. While the types of these sealing means are many and varied, one such means is shown as a flexible diaphragm pan or sealing ring designated 70 in FIGS. 2 and 4 as being structurally associated with door inner face 32. This sealing ring defines an elongated generally rectangular opening 72 which is slightly larger than rectangular opening 12 in the associated coke oven door frame B. As will be particularly noted from FIG. 4, the sides and ends of sealing ring 70 which define opening 72 have a generally U or J-shaped configuration defined by an inner leg 74, an outer leg 76 and a connecting leg 78. The outer leg is longer than the inner leg for reasons which will become apparent hereinafter. A knife-like sealing edge 80 which may be comprised of a number of alternative constructions extends peripherally around outer leg 76 for making engaging contact with the door frame in a manner which will be appreciated hereinafter.

The specifics of construction for sealing ring 70 are generally known in the art and include many structural variations. However, the above description and showings in the FIGURES are deemed sufficient for one skilled in the art to appreciate the overall concepts and scope of the subject invention. A plurality of mechanical fasteners generally designated 82 are conveniently employed to rigidly affix sealing ring 70 at inner leg 74 to inner planar face 32 of main door plate 30. It should be noted, however, that these mechanical fasteners are disposed inboard of the outer end of leg 76 and knife-like sealing edge 80.

Referring again to FIG. 2, conventional hook plates 86, 88 are provided and which may be rigidly affixed to outer planar face 34 by conventional means such as mechanical fasteners. These hook plates simply allow for the lifting and movement of the coke oven door by convenient crane means or the like.

With reference to FIGS. 1 and 2, it will be seen that latching assemblies generally designated 90, 92 are disposed toward opposite ends 40, 42 of the main door plate on outer planar face 34. As these assemblies are identical to each other, description will hereinafter be made to latching assembly 92, it being understood that latching assembly 90 is identical thereto unless otherwise noted.

To accommodate assembly 90, main door plate 30 includes an opening 94 therethrough. A latch bracket generally designated 96 is adapted to be rigidly mounted to outer face 34 by convenient means such as threaded fasteners of the like. The latch bracket includes a cylindrical opening adapted to closely receive a cylindrical latch bushing 98 which has a threaded internal surface. A latch bar screw 100 is provided which includes a threaded lower end 102, an outwardly extending flange 104 and an upper end 106. The lower end is threadedly received in latch bushing 98 and the upper end preferably has a square or other polygonal cross-sectional configuration to receive a wrench or other tool for reasons and purposes which will be appreciated hereinafter. A thrust bearing 108, a latch bar 110 including opposed radially extending arms 112, 114 and a washer 116 are all respectively received over upper end 106 of the latch bar screw with thrust bearing 108 disposed against flange 104 thereof. An appropriate retaining pin generally designated 118 is conveniently passed through a transverse opening (not shown) in upper end 106 to retain these various latter components in position. Latching assemblies 90, 92 are deemed conventional in the art so that further description thereof is unnecessary and the function thereof as applied to the concepts of the subject invention will be further described hereinafter.

In addition to conventional hook plates 86, 88 and conventional latching assemblies 90, 92, other miscellaneous items and openings may also be included in main door plate 30. For example, some installations utilize a small openig in the coke oven door which is commonly referred to as a coke oven leveler door. Other small doors or access openings are also sometimes provided and utilized for monitoring coking operations. As such other openings and items are conventional, they are not shown or discussed herein in any detail since they are not required to effectively practice the concepts of the subject invention.

Disposed about the outside of the support frame defined by side and end support plates 50, 52, 54 and 56 adjacent side and inboard of side and end edges 36, 38, 40 and 42 of main door plate 30 are plurality of separate, fabricated adjustment assemblies generally designated 130. These adjustment assemblies are utilized to conveniently adjust portions of sealing ring 70 over the periphery thereof in a manner to be discussed hereinafter. In a typical coke oven door arrangement, approximately 44 such assemblies are spaced around the support frame as defined by the side and edge support plates, although a greater or lesser number may be employed depending upon the specifics of the coke oven door dimensions, the specifics of the door frame B and the specifics of the actual sealing ring utilized. Moreover, it is preferred that the adjustment assemblies along the door sides be more closely spaced to each other adjacent the door ends since there are the areas of greatest door flexure during coking operations. As assemblies 130 are identical to each other, description will hereinafter be made with particular reference to FIG. 4 door are the concepts of rigidity v. flexibility. It is the flexible nature of the subject door which provides substantial advantages over the known and used coke oven doors.

More particularly, and after the subject door has been installed as generally outlined above and with the sealing ring adjusted as necessary to provide the desired initial sealing between the door and frame, the coking operation actually begun and the sealing ring readjusted to compensate as much as possible for further warping or have glassing of the frame due to increasing coke oven temperatures, the subject door flexes to permit continued sealing engagement between the door and the door frame, even after the outermost maximum adjustements have been made to the sealing ring. The stress relieved steel plate construction for the main door plate as well as the construction for the side support plates, end support plates and gusset members are such that the door is extremely strong while still allowing for flexing thereof through the action of latching assemblies 90, 92. The latch bar screws 100 of these two assemblies may, of course, be threadedly advanced into the associated latch brackets 96 so that a relatively high inward door sealing force is thereby generated. The gusseted arrangement provided by gusset members 58, 60, 62 and 64 is such to create a twisting action from the center of main door plate in an X-like fashion. This is important to establish generally zero movement at the center of the door and to create an extreme movement away from the center at the outermost door end edges. Since extreme door flexure occurs adjacent the door end edges, the individual adjustment assemblies 130 are more closely spaced together at these areas to allow more precise adjustment of sealing ring 70 thereat.

Under optimum conditions where oven door frame B and oven door C are perfectly straight, sealing edge 80 of sealing ring 70 will seal easily. The problem begins when the frame begins to distort in an hour-glass fashion and bows outwardly from the coke oven during oven operation. When the frame has excessive distortion such that the sealing ring can no longer be adjusted to be in sealing engagement therewith as outlined above, the practical operation of the subject invention as incorporated into the new and improved coke oven door allows the door itself to be flexed and moved inwardly toward the frame at that point and outwardly at the opposite point in a twisting fashion. With this flexure, the threaded adjusting plugs 170 of the individual adjustment assemblies 130 may be readjusted so as to again achieve the desired sealing engagement between the door and door frame. The overall structure which allows for this desirable end result is totally different from the types of structures heretofore known and utilized. Again, prior coke oven doors relied upon door rigidity in an attempt to achieve the desired results whereas the subject door assembly successfully employs the diametrically opposed concept of door flexibility to achieve the desired results.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. In a coke oven of the type having an elongated vertical opening in the front wall thereof with a door frame disposed about at least a portion of said opening, an elongated coke oven door adapted to be placed in a covering relationship with said opening and in a cooperative sealing relationship with said frame and further including means for releasably maintaining said door in position covering said opening and for urging said door toward said sealing relationship with said frame, the improvement comprising:

said door being fabricated from steel plate to including a main door plate having inner and outer planar faces, a pair of opposed side edges and a pair of opposed end edges with a portion of said inner face adapted to be closely spaced toward an engaging relationship with said frame; a steel side support plate rigidly affixed to said main door plate outer face adjacent each of said side edges and a steel end support plate rigidly affixed to said main door plate outer face adjacent each of said end edges, said side an end support plates extending generally normally outward from said outer face and forming a door support arrangement; and, a plurality of separate gusset members positioned generally symmetrically about the midpoint of said outer face and rigidly affixed thereto with each gusset member disposed to extend laterally across a portion of said outer face from one of said side plates in longitudinal alignment with a gusset member associated with the other of said side plates, whereby said fabricated coke oven door may be flexed during oven operation at elevated temperatures in response to the urging of said maintaining means so that said main door plate inner face will remain closely spaced toward an engaging relationship with said door frame as said frame is distorted due to exposure thereof to elevated oven temperatures and thereby maintain an effective seal between said oven door and frame.

2. The improvement as defined in claim 1 wherein said plurality of gusset members comprises two gusset members associated with each of said pair of side support plates, the gusset members associated with each of said side support plates being generally equidistantly spaced from and on opposite sides of the midpoint of said main door plate outer face.

3. The improvement as defined in claim 1 wherein said main door plate, side support plates, end support plates and gusset members are rigidly affixed to each other by means of welding.

4. In a coke oven of the type having an elongated vertical opening in the front wall thereof with a door frame disposed about at least a portion of said opening, an elongated coke oven door adapted to be placed in a covering relationship with said opening, separate sealing means associated with said coke oven door adapted for cooperative sealing engagement with said frame wherein said sealing means is affixed to said door for selective forced movement relative to the door inner face between defined limits to maintain proper sealing between said door and frame when a distorted condition is present therebetween, and further including means for releasably maintaining said door in position covering said opening and for urging said door toward said sealing relationship with said frame, the improvement comprising:

said door being fabricated from steel plate to include a main door plate having inner and outer planar faces, a pair of opposed side edges and a pair of opposed end edges with a portion of said inner face adapted to be closely spaced toward an engaging relationship with said frame; a steel side support plate rigidly affixed to said main door plate outer face adjacent each of said side edges and a steel end support plate rigidly affixed to said main door plate outer face adjacent each of said end edges, said side and end support plates extending generally normally outward from said outer face and forming a door support arrangement; a plurality of separate gusset members positioned generally symmetrically about the midpoint of said outer face and rigidly affixed thereto with each gusset member disposed to extend laterally across a portion of said outer face from one of said side plates in longitudinal alignment with a gusset member associated with the other of said side plates, whereby said fabricated coke oven door may be flexed during oven operation at elevated temperatures in response to the urging of said maintaining means so that said main door plate inner face will remain closely spaced toward an engaging relationship with said door frame as said frame is distorted due to exposure thereof to elevated oven temperatures and thereby maintain an effective seal between said oven door and frame; and, a plurality of separate fabricated adjustment means disposed in a spaced apart relationship from each other generally peripherally around said main door plate outer face adjacent said side and end support plates, each of said adjustment means extending through said main door plate from said outer to said inner face thereof in operative communication with said sealing means.

5. The improvement as defined in claim 4 wherein each of said plurality of fabricated adjustment means is comprised of:

an adjustment means housing rigidly affixed to said main door plate with said housing having an opening therethrough in coaxial alignment with a receiving opening in said main door plate communicating between said outer and inner faces thereof;

an adjustment plunger received in said housing opening with a portion thereof dimensioned to be received through said receiving opening into communication with said sealing means; and, means for selectively moving said adjustment plunger through said housing opening for forcibly moving a portion of said sealing means from a first normal position closely spaced to said main door plate inner face and a second position spaced outward of said inner face from said first position whereby selected portions of said sealing means may be adjusted to compensate for some relative distortion between said oven door and frame.

6. The improvement as defined in claim 5 wherein at least a portion of said housing opening is threaded and said moving means comprises a threaded member adapted to be threadedly received in said housing opening threaded portion; each said adjustement means further including biasing means for continuously urging said adjustement plunger toward engagement with said sealing means and for adjusting said sealing means through said plunger in response to threaded movement of said threaded member in said housing opening threaded portion and means for establishing a positive maximum limit for said sealing means second position.

7. The improvement as defined in claim 6 wherein said threaded member is separate from said adjustement plunger.

8. The improvement as defined in claim 6 wherein said plurality of adjustment means are disposed between the outer peripheral side and end edges of said main door plate outer face and said side and end support plates.

9. The improvement as defined in claim 8 wherein said adjustment means housings are rigidly affixed to the side walls of said side and end support plates.

10. A fabricated coke oven door for closing a generally rectangular opening in the front of a conventional coke oven wherein said opening is defined by a door frame, said oven door comprising:

a generally rectangular main door plate of stress relieved steel having inner and outer planar faces, a pair of opposed side edges and a pair of opposed end edges with a portion of said inner face adapted to be closely spaced toward said frame;

a steel side support plate rigidly affixed to said main door plate outer face adjacent each of said side edges and disposed to extend generally normally outward from said outer face;

a steel end support plate rigidly affixed to said main door plate outer face adjacent each of said end edges and disposed to extend generally normally outward from said outer face, said side and end support plates forming a generally rectangular door support arrangement;

a plurality of separate gusset members positioned generally symmetrically about the midpoint of said main door plate outer face and rigidly affixed thereto with each gusset member disposed to extend laterally across a portion of said outer face from one of said side support plates in longitudinal alignment with a gusset member associated with the other of said side plates;

a sealing ring disposed generally peripherally about and affixed to said main door plate inner face for cooperative sealing emgagement with said frame when said door is placed in a covering relationship with said coke oven opening, a portion of said sealing ring adapted for selective forced movement outward of said inner face between defined limits for maintaining a desired sealing relationship between said door and frame;

a plurality of separate fabricated adjustment means disposed in a spaced apart relationship from each other generally peripherally around said main door plate outer face adjacent said side and end support plates, each of said adjustment means extending through said main door plate from said outer to said inner face thereof into communication with said sealing ring, said adjustement means permitting selective adjustment of a portion of said sealing ring between said defined limits; and, means for releasably maintaining said door to position covering said opening an for urging said door and sealing ring toward a sealing relationship with said frame, whereby as the operating temperature inside said coke oven becomes elevated and said frame begins to distort therefrom thereby creating gaps between said sealing ring and frame, said sealing ring may be maintained in a sealing relationship with said frame by adjustment of said adjustment means to move at least selected portions of said sealing ring at said gaps back toward engagement with said frame and by flexure of said fabricated oven door itself under the influence of said door maintaining means.

11. The fabricated coke oven door as defined in claim 10 wherein said plurality of gusset members comprise two gusset members associated with each of said pair of side support plates, the gusset members associated with each of said side support plates being generally equidistantly spaced from and on opposite sides of the midpoint of said main door plate outer face.

12. The fabricated coke oven door as defined in claim 11 wherein said maintaining means comprises a pair of spaced apart maintaining means, said gusset members and the midpoint of said main door plate outer face being disposed between said pair of maintaining means such that flexure of said door occurs primarily adjacent the opposed ends thereof.

13. The fabricated coke oven door as defined in claim 10 wherein said main door plate, side plates, end plates and gusset members are rigidly affixed to each other by means of welding.

14. The fabricated coke oven door as defined in claim 10 wherein each of said plurality of fabricated adjustment means is comprised of: an adjustment means housing rigidly affixed to said main door plate with said housing having an opening therethrough in coaxial alignment with a receiving opening in said main door plate communicating between said outer and inner faces thereof; an adjustment plunger received in said housing opening with a portion thereof dimensioned to be received through said receiving opening into communication with said sealing ring; and, means for selectively moving said adjustment plunger through said housing opening for forcibly moving a portion of said sealing ring between a first normal position closely spaced to said main door plate inner face and a second position spaced outward of said inner face from said first position whereby selected portions of said sealing ring may be adjusted to compensate for some relative distortion between said fabricated oven door and frame.

15. The fabricated coke oven door as defined in claim 14 wherein at least a portion of said housing opening is threaded and said moving means comprises a threaded member adapted to be threadedly received in said housing opening threaded portion, each adjustement means further including biasing means for continuously urging said adjustment plunger toward engagement with said sealing ring and for adjusting said sealing ring through said plunger in response to threaded movement of said threaded member in said housing opening threaded portion and means for establishing a positive maximum limit for said sealing ring second position.

16. The fabricated coke oven door as defined in claim 15 wherein said threaded member is separate from said adjustment plunger.

17. The fabricated coke oven door as defined in claim 15 wherein said plurality of adjustment means are disposed between the outer peripheral side and end edges of said main door plate outer face and said side and end support plates.

18. The fabricated coke oven door as defined in claim 17 wherein said adjustment means housings are rigidly affixed to the side walls of said side and end support plates.

* * * * *